US009592512B2

(12) United States Patent
Andersson et al.

(10) Patent No.: US 9,592,512 B2
(45) Date of Patent: Mar. 14, 2017

(54) GYRATORY CRUSHER SPIDER ARM SHIELDS

(71) Applicant: SANDVIK INTELLECTUAL PROPERTY AB, Sandviken (SE)

(72) Inventors: Joel Andersson, Malmo (SE); Henrik Steede, Furulund (SE); Jan Johansson, Lomma (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 15/028,326

(22) PCT Filed: Sep. 19, 2014

(86) PCT No.: PCT/EP2014/069948

§ 371 (c)(1),
(2) Date: Apr. 8, 2016

(87) PCT Pub. No.: WO2015/051980

PCT Pub. Date: Apr. 16, 2015

(65) Prior Publication Data

US 2016/0250644 A1 Sep. 1, 2016

(30) Foreign Application Priority Data

Oct. 11, 2013 (EP) ..... 13188205

(51) Int. Cl.
*B02C 2/06* (2006.01)
*B02C 2/04* (2006.01)

(52) U.S. Cl.
CPC ..... *B02C 2/06* (2013.01); *B02C 2/042* (2013.01); *B02C 2/045* (2013.01)

(58) Field of Classification Search
CPC B02C 2/06; B02C 2/042; B02C 2/045; B02C 2/209; B02C 13/28; B02C 13/2804; B02C 2210/01; B02C 2210/02; B02C 4/305; G05B 19/404; G05B 19/406; G05B 2219/37256; G05B 19/04; B01F 7/00025
USPC ..... 241/209
See application file for complete search history.

(56) References Cited

U.S. PATENT DOCUMENTS

| | | | | |
|---|---|---|---|---|
| 1,717,759 A * | 6/1929 | Briggs | B02C 13/28 241/197 |
| 2,489,936 A | 11/1949 | Shafter | |
| 2,832,547 A | 4/1958 | Kennedy | |
| 3,026,051 A | 3/1962 | Saari | |
| 3,813,047 A | 5/1974 | Torrence et al. | |
| 3,845,578 A * | 11/1974 | Holmstrom | E02F 9/2833 37/446 |
| 4,467,971 A * | 8/1984 | Schuman | B02C 2/047 241/215 |

(Continued)

FOREIGN PATENT DOCUMENTS

| | | |
|---|---|---|
| EP | 2647438 A1 | 10/2013 |
| GB | 2123314 A | 11/1983 |

*Primary Examiner* — David Bryant
*Assistant Examiner* — Joseph Finan, Jr.
(74) *Attorney, Agent, or Firm* — Corinne R. Gorski

(57) ABSTRACT

A gyratory crusher includes a spider supported at a top shell, the spider having a pair of spider arms protected by respective arm shields. The shields are mounted and dismounted at the respective arms via a locking flange and notch and lug arrangement to avoid attachment by welding or attachment bolts.

13 Claims, 5 Drawing Sheets

(56) References Cited

U.S. PATENT DOCUMENTS

| | | | | |
|---|---|---|---|---|
| 4,748,754 | A * | 6/1988 | Schwappach | E02F 9/2816 172/713 |
| 5,080,294 | A * | 1/1992 | Dean | B02C 2/005 241/207 |
| 5,474,242 | A * | 12/1995 | Rafn | B23D 17/00 241/101.71 |
| 6,536,694 | B2 * | 3/2003 | Van Mullem | B02C 2/06 241/210 |
| 6,725,582 | B2 * | 4/2004 | Adamic | E02F 9/2833 37/456 |
| 6,848,203 | B2 * | 2/2005 | Hohmann | E02F 3/8152 37/446 |
| 7,451,944 | B2 * | 11/2008 | Hall | B02C 2/005 241/207 |
| 8,070,084 | B2 * | 12/2011 | Biggin | B02C 2/06 241/209 |
| 2002/0088888 | A1 | 7/2002 | Mullem | |
| 2011/0192927 | A1 | 8/2011 | Biggin | |

* cited by examiner

GYRATORY CRUSHER SPIDER ARM SHIELDS

RELATED APPLICATION DATA

This application is a §371 National Stage Application of PCT International Application No. PCT/EP2014/069948 filed Sep. 19, 2014 claiming priority of EP Application No. 13188205.2, filed Oct. 11, 2013.

FIELD OF INVENTION

The present invention relates to a gyratory crusher spider arm shield and in particular, although not exclusively, to a shield configured for secure and convenient mounting and dismounting at the spider arm so as to protect the arm from material to be crushed as it falls into the crushing zone.

BACKGROUND ART

Gyratory crushers are used for crushing ore, mineral and rock material to smaller sizes. Typically, the crusher comprises a crushing head mounted upon an elongate main shaft. A first crushing shell is mounted on the crushing head and a second crushing shell is mounted on a frame such that the two shells define together a crushing chamber through which the material to be crushed is passed. The main shaft is supported at its uppermost end by a top bearing housed within a central hub that forms a part of a spider assembly mounted on top of the topshell frame part. Spider arms project radially outward from the central hub to contact an outer rim at the top shell. The material to be crushed typically falls through the region between the spider arms and is prevented from causing damage to the arms by shields mounted over and about each arm. Example shields are disclosed in U.S. Pat. Nos. 2,489,936; 2,832,547; 3,026,051; US 2002/0088888; US 2011/0192927. It is to be noted, these shields are typically secured to the spider arm via attachment bolts that project axially downward relative to the longitudinal axis of the main shaft. However, such configurations are disadvantageous as the bolt heads are exposed to the crushable material falling into the crushing chamber. With use, the bolt heads become damaged leading to attachment failure and subsequent loss of the shield that falls downwardly into the crusher. Additionally, the threaded holes within the spider arms that receive the attachment bolts represent locations for stress concentrations that shorten the operation lifetime of the topshell assembly.

An alternative method of shield attachment involves welding the guards to the uppermost region of the spider arms. However, the welding process is both labour and time intensive and introduces additional problems when the worn shield requires removal. Additionally, the welding creates tension and stress concentrations into the spider arms. What is required is a spider arm shield that addresses the above problems.

SUMMARY OF THE INVENTION

It is an objective of the present invention to provide a shield or guard for a spider arm that may be conveniently attached and dismounted from the spider assembly without compromising the physical and mechanical integrity of the arm. It is a further objective to minimise, as far as possible, the time required to attach and remove the shield at the spider assembly whilst also minimising the number of personnel needed for attachment and dismantling. A further objective of the subject invention is to provide a means of attaching the arm shield without welding or attachment bolts that could otherwise damage the spider arm and/or represent regions for stress concentrations to occur.

It is a further specific objective to provide a means of attaching the arm shield that is independent of attachment of other components of the gyratory crusher.

The objectives are achieved by providing a gyratory crusher and spider arm shield assembly in which each shield is secured at each respective arm via cooperative components that abut one another to form an inter-locking configuration that obviates a requirement for welding or attachment bolts. The interlocking mechanism is formed, in part, by a locking flange positioned at a central hub that traps a radially inner first end of the shield axially downward onto the spider arm whilst a radially outer second end of the shield is hooked onto at least one lug that projects outwardly from the spider arm so as to prevent radially outward movement of the shield relative to the arm.

Accordingly, by the cooperative engagement of the shield at its radially inner and outer (first and second) ends, the shield is trapped into mating contact onto the upper region of the spider arm. Mounting and dismounting is achieved via locking and release of the central flange at the hub that once removed allows the shield to be conveniently hinged upwardly from the arm and the arm lug disengaged. Such a configuration is advantageous to minimise the time required for mounting and dismounting of the shield at the arm and secondly to provide a robust mechanism of attachment that does not create stress and stress concentrations at the spider arm. The present means of attachment also provide enhanced attachment integrity over a conventional arrangement where it is not uncommon for attachment bolts to snap or welding to fail due to the significant loading forces encountered within the crusher due to the passage of the crushable material and the forces resultant from the crushing action.

According to a first aspect of the present invention there is provided a gyratory crusher comprising: an upper shell; a spider supported at the shell, the spider having a plurality of spider arms extending radially outward from a hub; a plurality of arm shields mounted at the respective arms, each shield having a first end for positioning at or towards the hub and a second end positioned radially outward from the hub; characterised by: at least one lug projecting from each arm and a locking flange secured to the hub; each of the shields comprising at least one notch to engage each respective lug to inhibit radially outward movement of the shield relative to the arm; wherein at least a portion of the flange is seated on top of the first end of the shield that in combination with the lug and notch locks each of the shields axially and radially at each of the respective arms.

Preferably, the lug is positioned at a radially outer region of the arm and the notch is positioned towards the second end relative to the first end of the shield. This configuration is advantageous to radially separate the respective contact of the locking flange and lug at the respect radially inner and outer ends of the shield to maximise the strength of attachment and to allow convenient mounting and dismounting via a hinge like rotation of the shield about the lug.

Preferably, the notch is formed as a hooked portion such that a mouth of the hooked portion is orientated towards the radially outer region of the arm away from the hub. Accordingly, the shield may be conveniently mounted at the lug as it is lowered downwardly onto the arm at a declined angle with the second end of the shield and mouth of the notch orientated towards the lug.

Preferably, the flange comprises an annular disc-like configuration and the crusher comprises a spider cap secured on top of the hub and the flange. A substantially planar flange is advantageous for convenient positioning at the hub to provide a compact arrangement that minimises the axial height of the hub, flange and spider cap assembly within the input hopper. An annular flange is also advantageous to provide multiple regions of attachment distributed circumferentially around the crusher axis. Preferably, the flange is secured to the hub via a plurality of fastenings that are independent of an attachment of the spider cap to the hub to allow the cap to be attached and removed at the hub independently of the flange. Such an arrangement is advantageous to allow the spider cap to be removed and interchanged without affecting attachment of the spider shield. The attachment strength of the flange at the hub may also be selectively different from the respective attachment of the cap at the hub.

Optionally, the shield comprises a step at the first end to engage the flange. According to further specific implementations, the first end of the shield may comprise any configuration suitable for abutment by the flange to allow the flange to be pressed downwardly onto the first end of the shield. This step is advantageous to allow an operator to determine if the shield has been engaged correctly by secure mating of the flange within the step.

Optionally, the lug is formed as a cylindrical peg projecting outwardly from a side surface of the arm. Preferably, the lug is aligned perpendicular to the radial length of the shield and in particular, a first part of the spider arm that projects radially outward from the hub. According to the subject invention, the crusher is devoid of screws, bolts and/or welding to secure the shields to the respective arms. Accordingly, the present arrangement is advantageous as each shield is releasably attached at each respective arm exclusively by the cooperative contact between i) the flange and the first end of the shield and ii) the lug and the respective notch.

Preferably, the shield further comprises a lifting hole to allow the shield to be engaged and raised and lowered relative to the arm wherein the hole is positioned eccentrically with respect to a mass centre of the shield such that when the shield is suspended by the hole the shield is configured to hang at a declined angle with the second end lower than the first end such that the notch is orientated to engage the lug. Optionally, the shield may further comprise any means of attachment to a lifting rig or crane including for example an eyelet, hook or other component engageable by a chain or lifting belt.

Preferably, each arm comprises two lugs projecting laterally from side surfaces of the arm and each shield comprises two respective notches provided at respective sides of the shield to engage each of the two respective lugs. Preferably, the lugs are aligned coaxially to extend laterally from the opposed sides of the arm at a radially outward region and at an axially upper region.

Preferably, the shield comprises a main body having an underside foot for positioning on top of the arm and a pair of sidewalls extending downwardly from the main body at each lengthwise side of the underside foot, the sidewalls positionable over a part of side faces of the arm; wherein the notches are provided in each respective sidewall. Preferably, the shield further comprises a plurality of axially extending walls or ridges that project upwardly from an upward facing side of the shield to create radially extending channels intended to collect the crushable material as it flows downwardly passed the arms.

Preferably, a part of the flange projects radially outward beyond the hub to extend over a part of the shield at the first end. Accordingly, the flange may comprise an oval or elliptical configuration arranged lengthwise with the pair of diametrically opposed spider arms to extend outwardly and onto the radially inner regions of each shield located at each respective arm.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
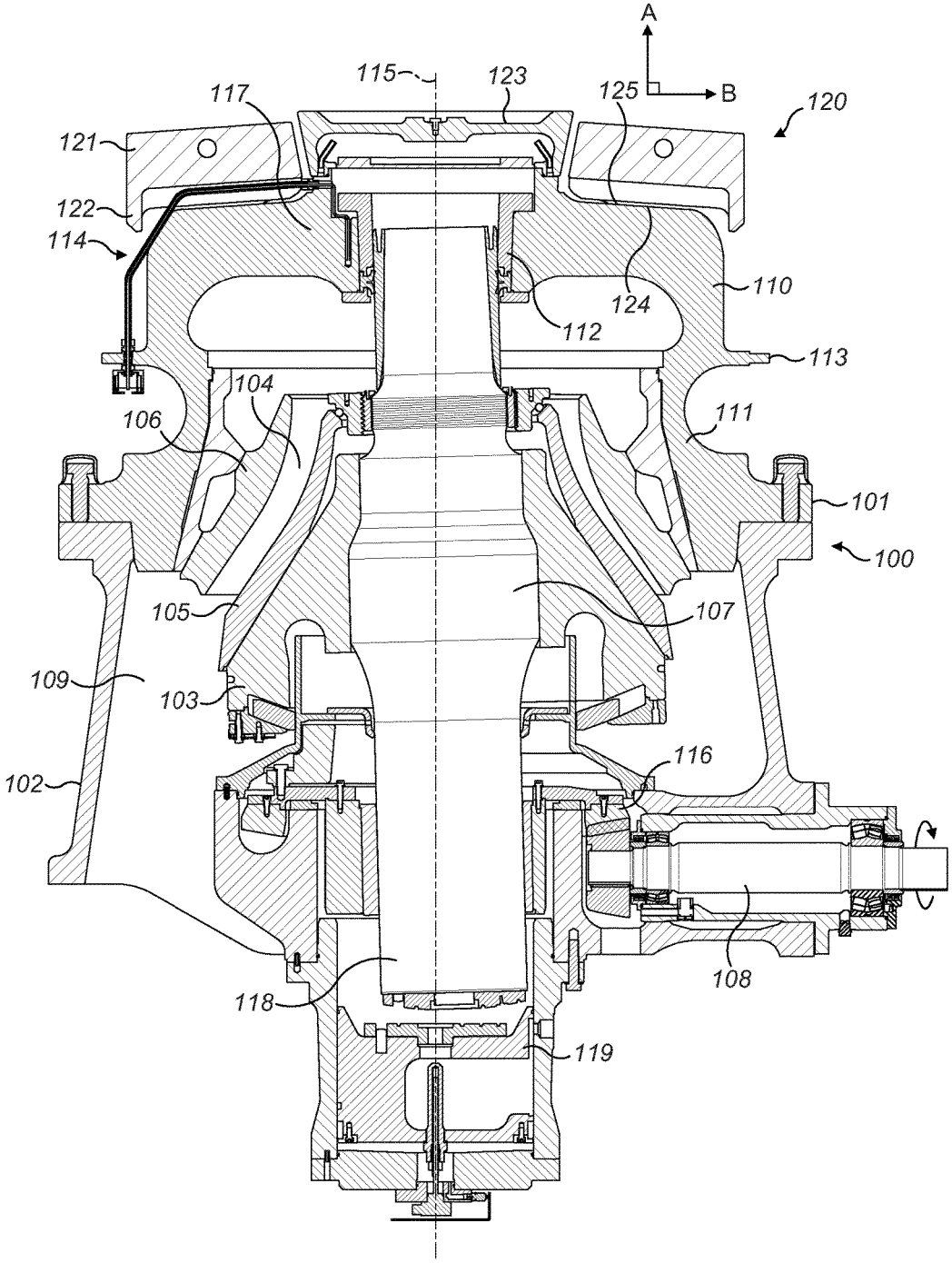
FIG. 1 is a cross sectional side view of a gyratory crusher having an upper frame part, a lower frame part and rotatable main shaft and a spider assembly mounted at the upper frame part to support and stabilise the main shaft according to a specific implementation of the present invention.

Referring to FIG. 1, a crusher comprises a frame 100 having an upper frame 101 and a lower frame 102. A crushing head 103 is mounted upon an elongate shaft 107. A first (inner) crushing shell 105 is fixably mounted on crushing head 103 and a second (outer) crushing shell 106 is fixably mounted at upper frame 101. A crushing zone 104 is formed between the opposed crushing shells 105, 106. A discharge zone 109 is positioned immediately below crushing zone 104 and is defined, in part, by lower frame 102.

A drive (not shown) is coupled to main shaft 107 via a drive shaft 108 and suitable gearing 116 so as to rotate shaft 107 eccentrically about longitudinal axis 115 and to cause head 103 to perform a gyratory pendulum movement and crush material introduced into crushing chamber 104. An upper end region of shaft 107 is maintained in an axially rotatable position by a top-end bearing assembly 112 positioned intermediate between main shaft 107 and a central hub 117. Similarly, a bottom end 118 of shaft 107 is supported by a bottom-end bearing assembly 119.

Upper frame 101 is divided into a topshell 111, mounted upon lower frame 102 (alternatively termed a bottom shell), and a spider assembly 114 that extends from topshell 111 and represents an upper portion of the crusher. The spider 114 comprises two diametrically opposed arms 110 that extend radially outward (in direction B) from a central hub 117 positioned on a longitudinal axis 115 extending through frame 100 and the gyratory crusher generally (indirection A). Arms 110 are attached to an upper region of topshell 111 via an intermediate annular flange (or rim) 113 that is centred around longitudinal axis 115. Typically, arms 110 and topshell 111 form a unitary structure and are formed integrally. A cap 123 extends over an upper region of shaft 107 and central hub 117 so as to protect the working components at the upper region of the crusher. In order to protect the spider arms 110 from the crushable material that falls downwardly into the topshell 111, an arm shield 120 is mated onto and around each arm 110. Each shield 120 comprises a main body 121 with an underside surface 124 that is configured to sit on top of an upper facing surface 125 of each arm 110. Each shield 120 also comprises a pair of sidewalls 122 that extend downwardly over the respective sides of each arm 110.

Referring to FIGS. 2 to 6, each arm comprises a generally radially extending part 200 (aligned substantially with direction B) and a generally axially extending part 201 projecting substantially downward (in direction A) from a radially outermost end of part 200. Arm part 201 terminates at an upper surface of rim 113. A shoulder 208 is located at the junction between part 200 and part 201.

Figure 2:
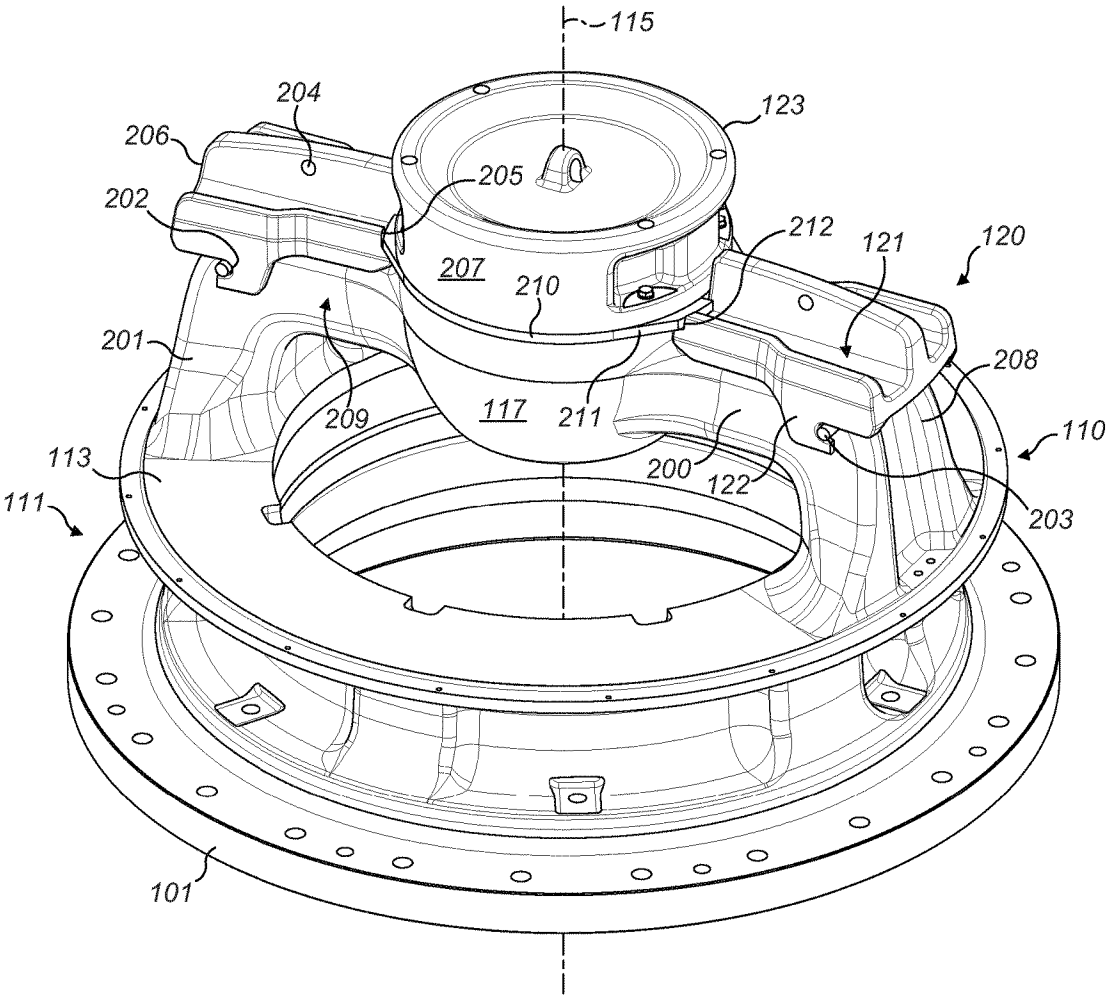
FIG. 2 is a perspective view of the spider assembly of FIG. 1 with arm shields secured in position over each respective spider arm according to a specific implementation of the present invention.

A pair of substantially cylindrical lugs (or projections) extend laterally from each side surface 209 of arm 110 at the region of shoulder 208. Each lug of the pair is aligned coaxially and extends perpendicular to the radial length of shield 120 and the first arm part 200. Each shield 120 comprises a pair of notches 202 formed in each respective sidewall 122. Each notch 202 is formed as a hooked portion of sidewall 122 with a mouth that is orientated radially outward towards second end 206 and away from hub 117. Accordingly, the shield second end 206 is secured at arm shoulder 208 via a cooperative engagement of each lug 203 within each respective notch 202. Each shield 120 is therefore locked radially by engagement of lugs 203 within notches 202. An annular disc-like flange 210 is mounted at hub 117 and is positioned axially below cap 123. Flange 210 comprises a generally circular configuration having a diameter corresponding to that of cap 123. Flange 210 further comprises a pair of radial extensions 211 that project radially outward from the cap outer surface 207 so as to extend a short radial distance above arm section 200. A step 212 is formed at each shield first end 205 and is configured and dimensioned to receive and engage with the flange radial extension 211. Accordingly, when seated in position as illustrated in FIG. 2, extension 211 abuts downwardly onto a radially innermost region of shield 122 to both axially and radially lock each shield 122 at each respective arm 110 via the engagement between flange extension 211, step 212 and lugs 203 received within notches 202.

Figure 3:
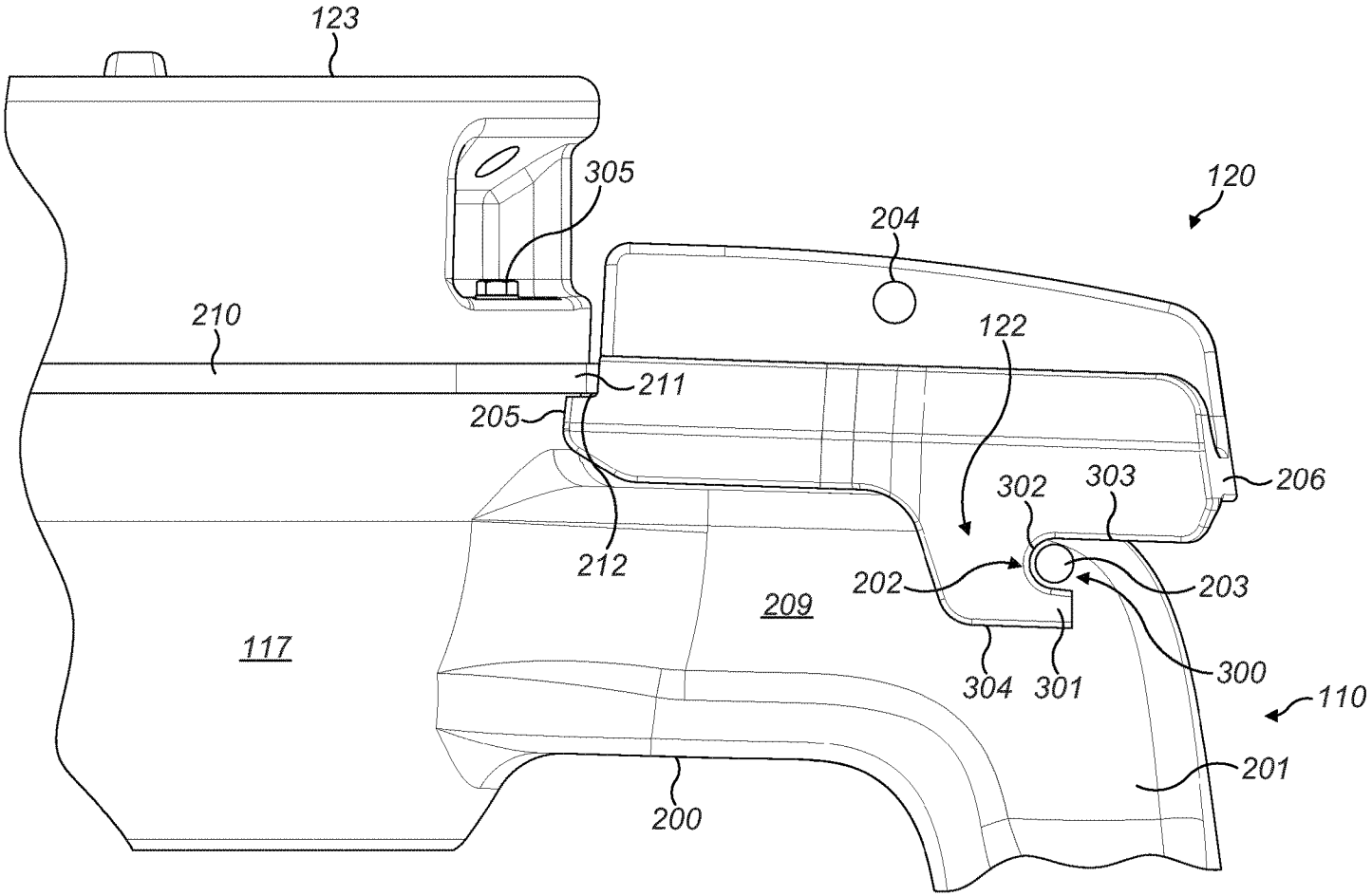
FIG. 3 is a side elevation view of one of the spider arms and shields of FIG. 2.

Referring to FIG. 3, notch 202 is formed in each respective sidewall 122 (that projects axially downward to at least partially cover a part of arm side surface 209) as a recess or slot and is positioned at an axially lower and radially outer region of sidewall 122. In particular, the slot is defined by a curved edge 302 having a part or semi-circular profile at an innermost region of the recess. One end of the curved edge 302 continues into shield edge 303 that extends radially between notch 202 and the second radially outermost end 206. A second end of the curved edge 302 extends into a further shield edge 304 representing a lowermost region of the shield 120 that extends radially between notch 202 and the radially inner first end 205. Accordingly, a lowermost part of wall 122 positioned immediately below notch 202 is formed as a foot 301 to hook axially under lug 203 that is received within the notch (or recess) 202. According to the specific implementation, when the shield 120 is located in position over arm 110, the outer cylindrical surface of each lug 203 is positioned in contact or near touching contact with the semi-circular innermost notch edge 302. The axial separation of foot 301 from shield edge 303 is formed as a notch mouth 300 to allow the lug 203 to be inserted and removed at the hooked notch 202.

Figure 4:
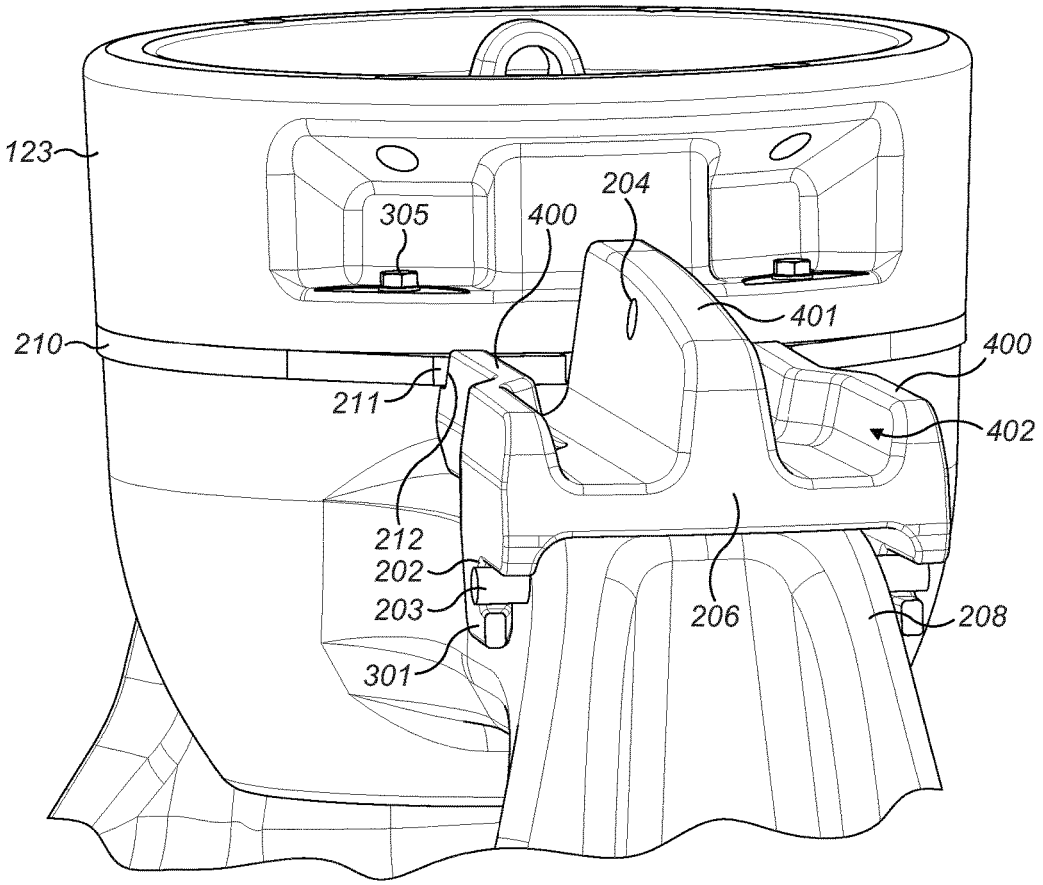
FIG. 4 is an end view of the shield and arm of FIG. 3.

Referring to FIG. 4, each shield 120 comprises a pair of outer channel walls 400 that project axially upward form main body 121 and are formed as axial upward extensions of sidewalls 122. A central channel wall 401 is positioned intermediate outer walls 400 with all channel walls 400, 401 extending the radial length of shield 120 between first and second ends 205, 206. Accordingly, the region between walls 400, 401 define channels 402 to collect crushable material to form a domed stockpile that acts to protect the shield 120 and arm 110 during use. Lifting hole 204 is formed through an axially upper region of central channel wall 401 and is positioned eccentrically with respect to a mass centre of shield 120 in a radial direction between ends 205, 206. Accordingly, when shield 120 is suspended by a lifting crane or belt, via hole 204, shield 120 is inclined with second end 206 axially lower than first end 205. This is advantageous to orientate mouth 300 towards lug 203 so as to facilitate engagement of each lug 203 within the hooked recess or notch 202. Shield first end 205 may then be pivoted or hinged about the coaxial lugs 203 during a final lowering stage (or as an initial dismounting stage).

Figure 5:
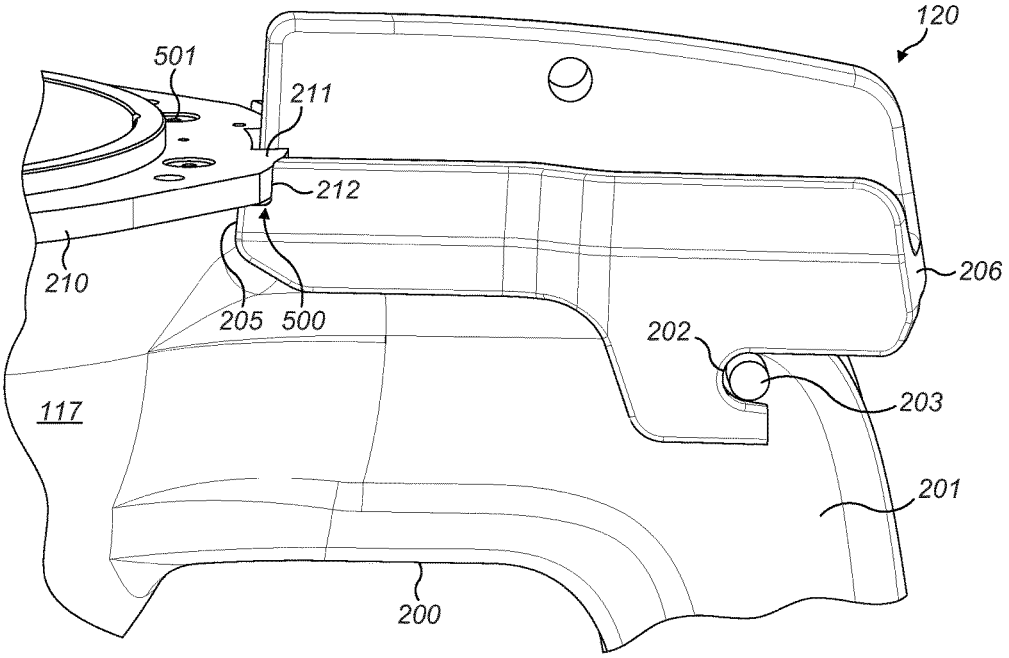
FIG. 5 is a side elevation view of the arm and shield of FIG. 3 with the spider cap removed.
Figure 6:
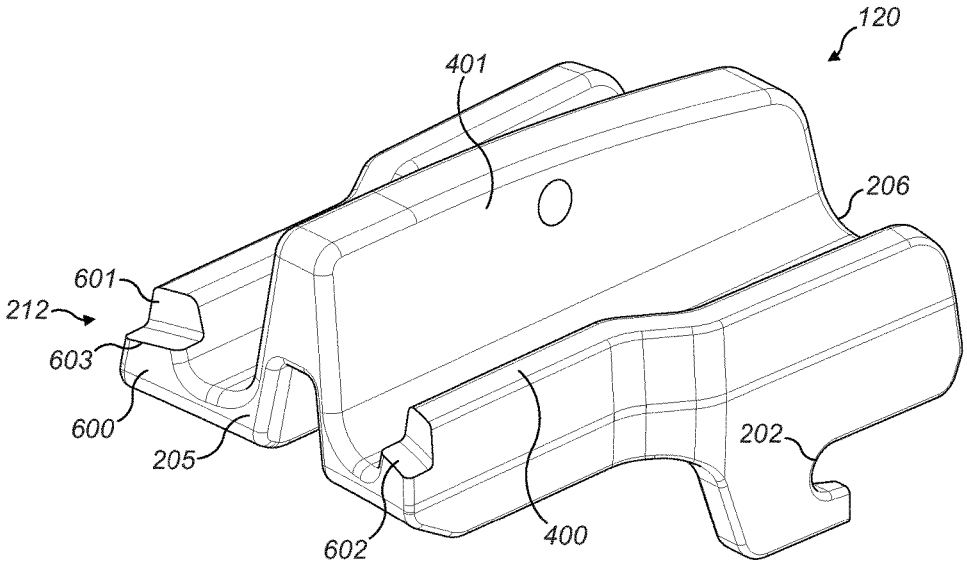
FIG. 6 is a perspective view of the arm shield of FIGS. 1 to 5.

Referring to FIG. 5, the disc-like flange 210 comprises a plurality of bores 501 aligned axially with axis 115 to receive anchorage bolts 305 (illustrated in FIGS. 3 and 4). Bolts 305 are further received within suitable threaded bores (not shown) extending axially into hub 117 immediately below flange 210. As illustrated in FIG. 5, each radial flange extension 211 projects radially outward from central hub 117 so as to overhand hub 117 to create a pair of diametrically opposed lips 500, each lip 500 positioned vertically above a radially innermost region of each respective arm part 200. Each lip 500 is configured to contact step 212 such that a radially innermost region of shield 120 at first end 205 is trapped axially between lip 500 and the radially innermost region of arm part 200. Referring to FIG. 6, step 212 is formed within the radially innermost ends of the respective channel side walls 400. In particular, the shield first end 205 comprises an end face 600 that terminates at each channel wall 400 in a step edge 603. A first step surface 602 is aligned substantially horizontally and coplanar with the main downward facing surface of flange 210. Step 212 is further defined by a second step surfaces 601 aligned perpendicular to first surface 602 with second surfaces 601 aligned substantially with axis 115. The first and second step surfaces 602, 601 are configured to abut the radially outermost region of flange extension 211 when shield 120 is located in full mated position at each at in 110.

The invention claimed is:

1. A gyratory crusher comprising:

an upper shell;

a spider supported at the shell, the spider having a plurality of spider arms extending radially outward from a hub;

a plurality of arm shields mounted at the respective arms, each shield having a first end for positioning at or towards the hub and a second end positioned radially outward from the hub; and at least one lug projecting from each arm and a locking flange secured to the hub, each of the shields including at least one notch to engage each respective lug to inhibit radially outward movement of the shield relative to the arm, wherein at least a portion of the flange is seated on top of the first end of the shield that in combination with the lug and notch locks each of the shields axially and radially at each of the respective arms, the lug being positioned at a transition region of the arm corresponding to an outermost region of a first part of the arm that extends generally outward from the hub and a second part of the arm that extends generally axially downward from the outermost end of the first part to mount the arm at a rim of the shell.

2. The crusher as claimed in claim 1, wherein the lug is positioned at a radially outer region of the arm and the notch is positioned towards the second end relative to the first end of the shield.

3. The crusher as claimed in claim 2, wherein the notch is formed as a hooked portion such that a mouth of the hooked portion is orientated towards the radially outer region of the arm away from the hub.

4. The crusher as claimed in claim 3, wherein the flange includes an annular disc-like configuration and the crusher comprises a spider cap secured on top of the hub and the flange.

5. The crusher as claimed in claim 4, wherein the flange is secured to the hub via a plurality of fastenings that are independent of an attachment of the spider cap to the hub to allow the cap to be attached and removed at the hub independently of the flange.

6. The crusher as claimed in claim 5, wherein the shield includes a step at the first end to engage the flange.

7. The crusher as claimed in claim 6, wherein the lug is formed as a cylindrical peg projecting outwardly from a side surface of the arm.

8. The crusher as claimed in claim 7, wherein the crusher is devoid of screws, bolts and/or welding to secure the shields to the respective arms.

9. The crusher as claimed in claim 8, wherein each shield is releasably attached at each respective arm exclusively by the cooperative contact between the flange and the first end of the shield, and the lug and the respective notch.

10. The crusher as claimed in claim 1, wherein the shield includes a lifting hole to allow the shield to be engaged and raised and lowered relative to the arm wherein the hole is positioned eccentrically with respect to a mass centre of the shield such that when the shield is suspended by the hole the shield is configured to hang at a declined angle with the second end lower than the first end such that the notch is orientated to engage the lug.

11. The crusher as claimed in claim 1, wherein each arm includes two lugs projecting laterally from side surfaces of the arm and each shield having two respective notches provided at respective sides of the shield to engage each of the two respective lugs.

12. The crusher as claimed in claim 11, wherein the shield includes a main body having an underside foot for positioning on top of the arm and a pair of sidewalls extending downwardly from the main body at each lengthwise side of the underside foot, the sidewalls being positionable over a part of side surfaces of the arm, wherein the notches are provided in each respective sidewall.

13. The crusher as claimed in claim 1, wherein a part of the flange projects radially outward beyond the hub to extend over a part of the shield at the first end.

* * * * *